US005527250A

United States Patent [19]

Chen

[11] Patent Number: 5,527,250

[45] Date of Patent: Jun. 18, 1996

[54] HORSE-RIDING TYPE EXERCISER AND STEPPER COMBINATION

[76] Inventor: Paul Chen, 5th Floor, No. 31, Gan Tzou 2nd Street, Shi Tun Chu, Taichung, Taiwan

[21] Appl. No.: 533,657

[22] Filed: Sep. 25, 1995

[51] Int. Cl.[6] ..... A63B 21/068; A63B 23/035

[52] U.S. Cl. ..... 482/96; 482/52; 482/97

[58] Field of Search ..... 482/51, 52, 70–72, 482/137, 95, 96, 57, 111, 130; 472/106, 111; D21/191, 198

[56] References Cited

U.S. PATENT DOCUMENTS

| | | | |
|---|---|---|---|
| 4,684,126 | 8/1987 | Dalebout et al. | 482/72 |
| 5,242,340 | 9/1993 | Jerome | 482/52 |
| 5,284,461 | 2/1994 | Wilkinson et al. | 482/147 |
| 5,338,277 | 8/1994 | Yang | 482/52 |
| 5,356,357 | 10/1994 | Wang et al. | 482/96 |
| 5,421,796 | 6/1995 | Chen | 482/96 |
| 5,429,568 | 7/1995 | Chen | 482/57 |

FOREIGN PATENT DOCUMENTS

| | | | |
|---|---|---|---|
| 2186498 | 8/1987 | United Kingdom | 482/72 |

*Primary Examiner*—Jerome Donnelly
*Attorney, Agent, or Firm*—Charles E. Baxley

[57] ABSTRACT

An exerciser includes a seat post pivotally coupled to the front portion of a base and having a seat cushion disposed on top. A pole is coupled between the seat post and the base. A pair of foot posts are pivotally coupled to the seat post and are coupled to the pole for elevating the seat cushion when the foot posts are rotated by the users. A pair of resilient elements are pivotally coupled between the foot posts and the seat post for independently rotating the foot posts so as to conduct stepping exercises when the pole is not coupled to the foot posts.

3 Claims, 3 Drawing Sheets

HORSE-RIDING TYPE EXERCISER AND STEPPER COMBINATION

BACKGROUND OF THE INVENTION

1. Field of the Invention

The present invention relates to an exerciser, and more particularly to a horse-riding type exerciser and stepper combination.

2. Description of the Prior Art

Various kinds of horse riding type exercisers have been developed. Four prior arts are disclosed in U.S. Pat. No. 5,342,269 to Huang et al. issued Aug. 30, 1994; U.S. Pat. No. 5,356,357 to Wang et al. issued Oct. 18, 1994; U.S. Pat. No. 5,356,358 to Chen issued Oct. 18, 1994; and U.S. Pat. No. 5,366,428 to Liao issued Nov. 22, 1994.

However, the typical horse riding type exercisers can be used as pull type exercisers only and can not be used as stepper exercisers.

The present invention has arisen to mitigate and/or obviate the afore-described disadvantages of the conventional horse riding type exercisers.

SUMMARY OF THE INVENTION

The primary objective of the present invention is to provide a horse-riding type exerciser which can be used for conducting both pull type horse riding exercises and stepping exercises.

In accordance with one aspect of the invention, there is provided a horse riding type exerciser comprising a base including a front portion having a pivot shaft provided therein, including a rear portion having a track means provided therein, a seat post including a lower portion pivotally coupled to the base at the pivot shaft, and including an upper portion having a seat cushion provided thereon, and including a middle portion having a pair of projections extended therefrom, a pole means including a lower portion movably engaged in the track means and including an upper portion pivotally coupled to the middle portion of the seat post, a pair of foot posts each including a lower portion pivotally coupled to the lower portion of the seat post at a pivot axis and each including an upper portion having a foot pedal means provided thereon, the foot posts each including a middle portion having an extension extended therefrom, means pivotally coupling the foot posts to the pole means for moving the lower portion of the pole means along the track means so as to elevate the seat cushion when the foot posts are rotated about the pivot axis, and a pair of resilient elements pivotally coupled between the extensions and the projections respectively so as to resiliently coupling the foot posts to the seat post, the foot posts being allowed to be rotated about the pivot axis independently in order to conduct stepping exercises when the coupling means is disengaged from the foot posts.

A spindle is provided in the middle portion of the seat post, a bar means includes a first end pivotally coupled to the spindle and a second end having a rod secured thereto, the coupling means includes a link pivotally coupled between the rod and the pole means and includes a lever having a first end pivotally coupled to the rod and having a second end pivotally coupled to the foot posts, the rod is rotated about the spindle by the lever when the foot posts are rotated about the pivot axis, and the lower portion of the pole means is moved along the track means by the link when the bar means is rotated about the spindle.

A pair of handle bars each includes a lower portion secured to the bar means so as to rotate the bar means about the spindle.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
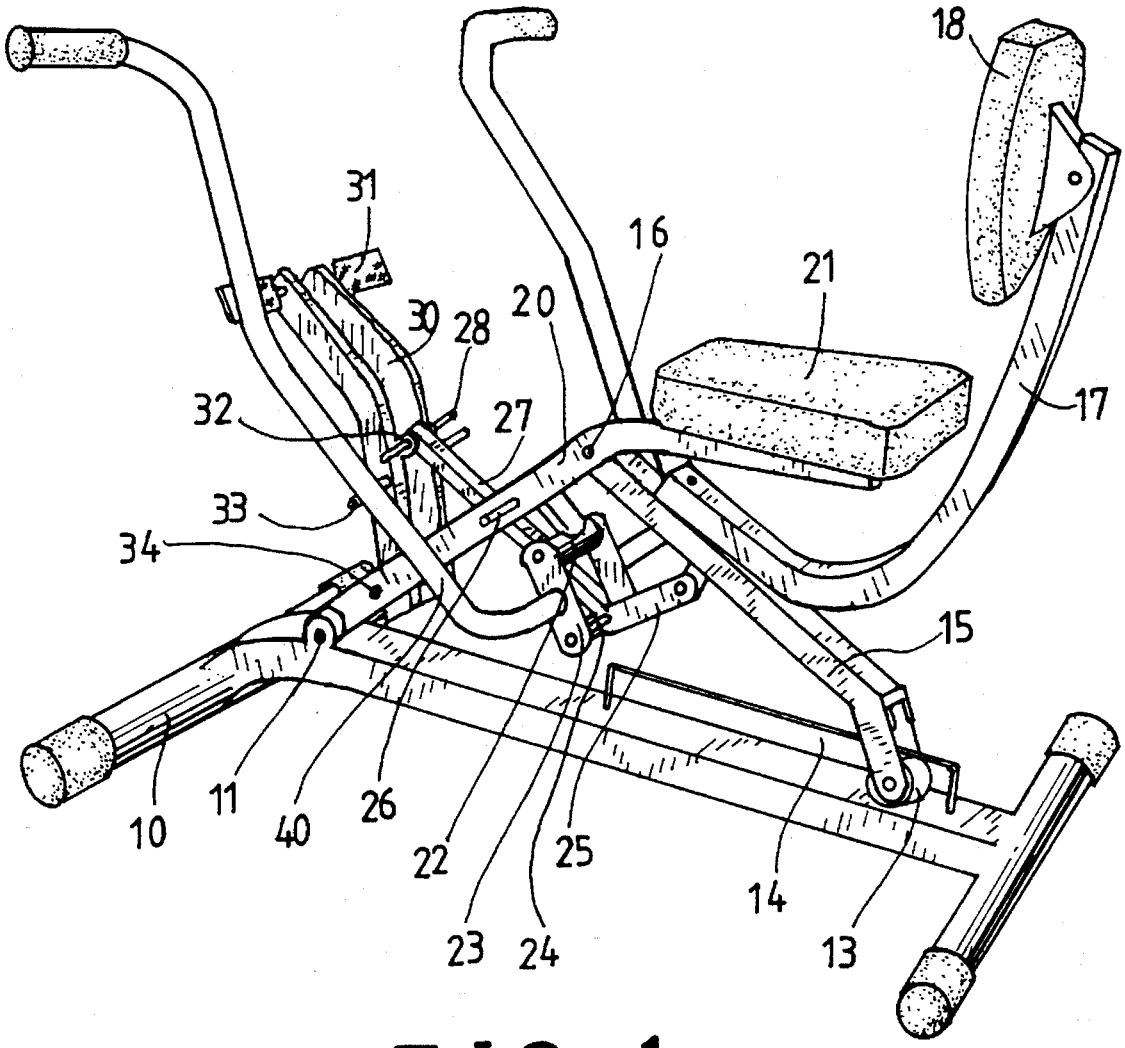
FIG. 1 is a perspective view of a horse-riding type exerciser in accordance with the present invention.
Figure 2:
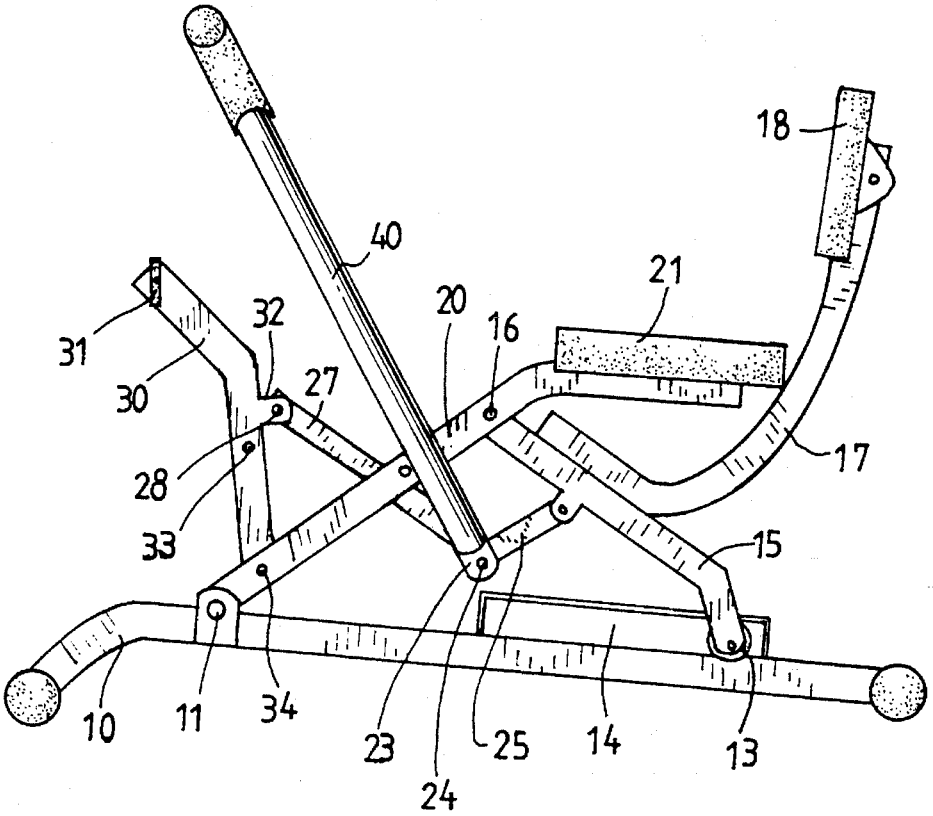
FIGS. 2 and 3 are plane views illustrating the operation of the horse-riding type exerciser.

Referring to the drawings, and initially to FIGS. 1 and 2, a horse-riding type exerciser in accordance with the present invention may be used for conducting pull type horse riding exercises and stepping exercises. The exerciser in accordance with the present invention comprises a base 10 including a pivot shaft 11 provided in the front portion and including a track 14 provided in the rear portion. A pole 15 includes a roller 13 secured to the lower portion for rotatably engaging in the track 14 of the base 10 such that the roller 13 may move along the track 14. A seat post 20 includes a lower portion pivotally coupled to the base 10 at the pivot shaft 11 and includes a seat cushion 21 provided on the upper portion thereof. A back support 17 is secured on the pole 15 and includes a back cushion 18 provided on top thereof. The upper end portion of the pole 15 is pivotally coupled to the middle portion of the seat post 20 at a pivot pin 16 such that the roller 13 may be caused to move along the track 14 when the seat post 20 is rotated about the pivot shaft 11.

A pair of foot posts 30 include a lower portion pivotally coupled to the lower portion of the seat post 20 at a pivot axis 34 or pivotally coupled to the pivot shaft 11 and includes a pair of foot pedals 31 secured on top of the foot posts 30 respectively. The foot posts 30 each includes a lug 32 and an extension 33 extended therefrom.

The seat post 20 includes a spindle 22 provided in the middle portion thereof. A pair of bars 23 have one end pivotally coupled to the spindle 22 and have a rod 24 secured to the other end thereof. A link 25 is pivotally coupled between the rod 24 and the pole 15. A pair of handle bars 40 have a lower portion secured to the bars 23 respectively so as to rotate the bars 23 about the spindle 22 and so as to move the pole 15 forward by the link 25. A lever 27 includes one end pivotally coupled to the rod 24 and includes the other end pivotally coupled to the lugs 32 of the foot posts 30 by a pivot axle 28, such that the pole 15 may be moved forward toward the seat post 20 by the link 25 and the lever 27 when the foot posts 30 are rotated away from the seat post 20 about the pivot shaft 11. The seat post 20 includes a pair of projections 26 laterally extended therefrom.

Figure 3:
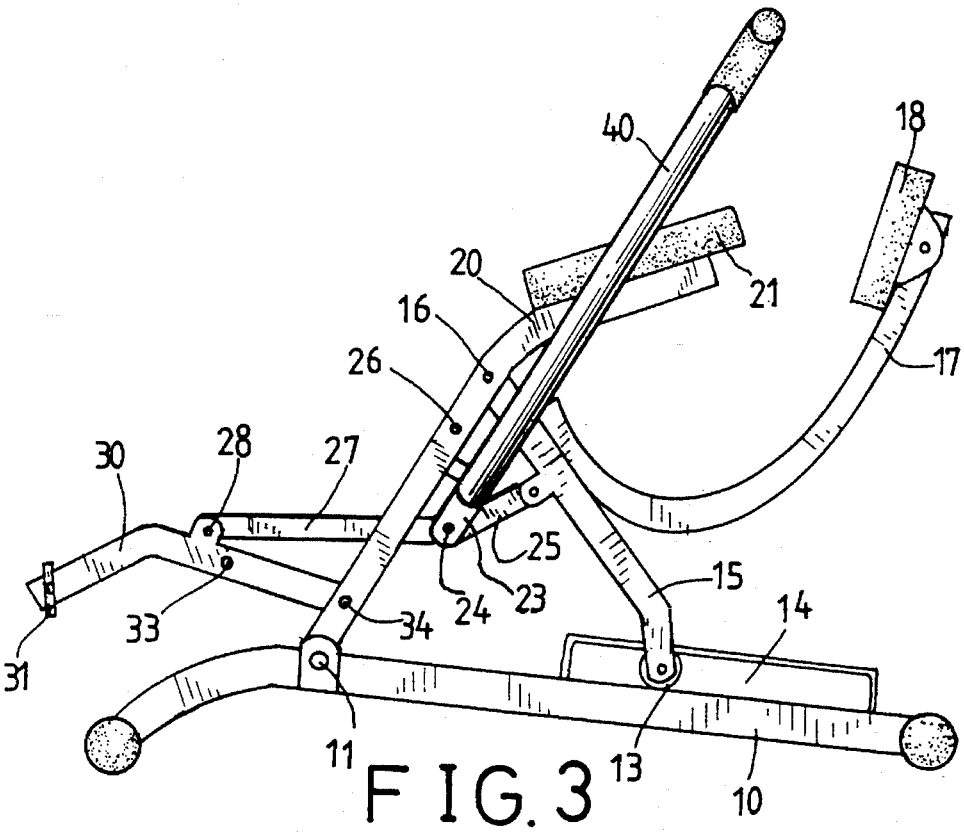

In operation, as shown in FIGS. 2 and 3, when the lever 27 is coupled to the foot posts 30 by the pivot axle 28, the pole 15 may be pulled forward by the lever 27 and the link 25 when the foot posts 30 are rotated by the users and/or when the handle bars 40 are pulled by the users, such that the seat cushion 21 may be elevated and such that the users may conduct pull type horse riding type exercises.

Figure 4:
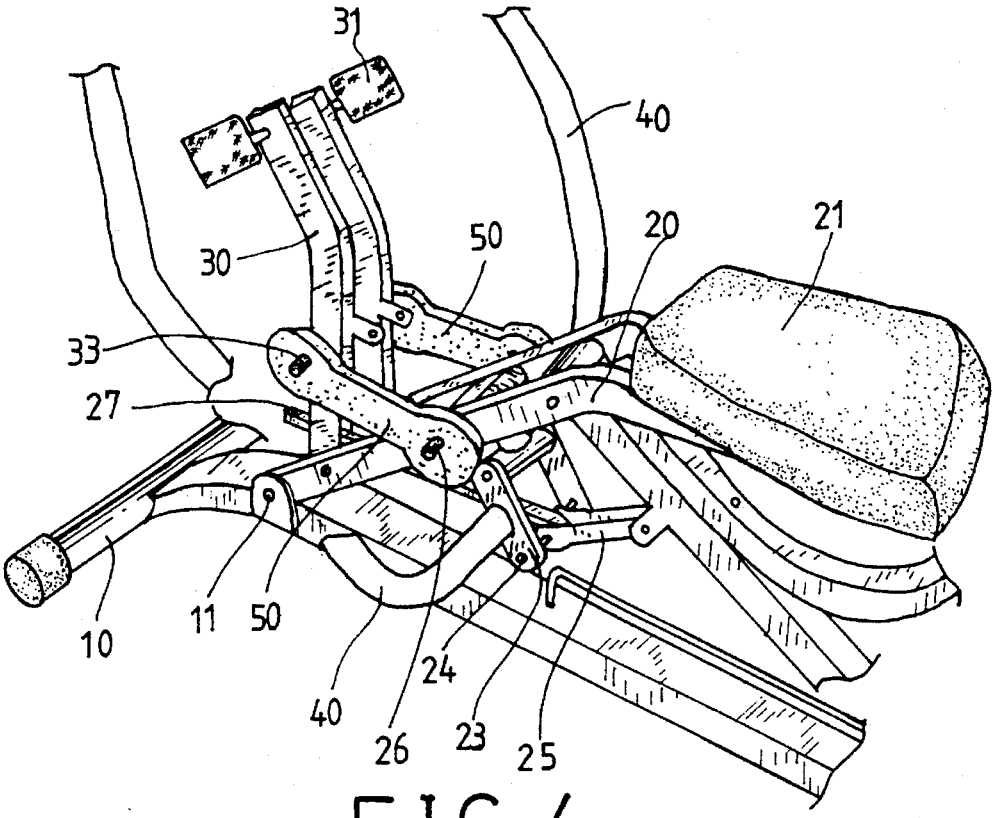
FIGS. 4 and 5 are perspective views illustrating the operation of the horse-riding type exerciser as a stepping exercisers.
Figure 5:
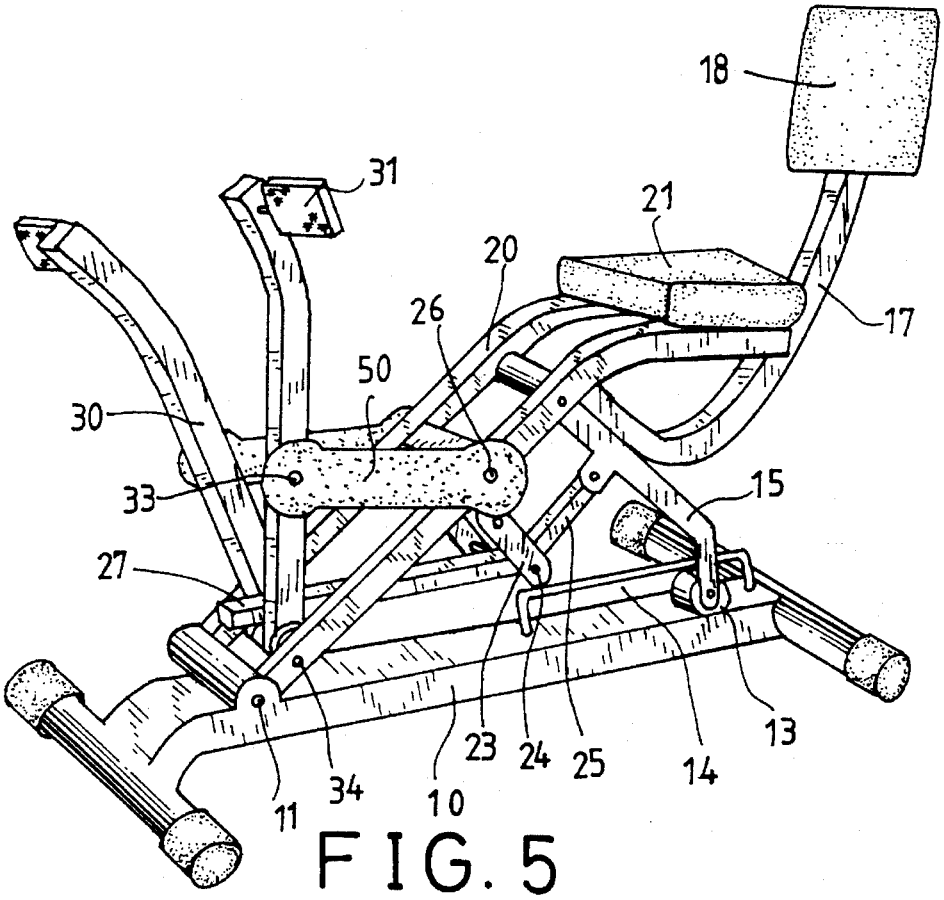

However, as shown in FIGS. 4 and 5, when the pivot axle 28 is disengaged from the lugs 32 of the foot posts 30, the lever 27 may be disengaged from the lugs 32. At this moment, the foot posts 30 may be rotated about the pivot axis 34 independently. Two resilient elements 50 are engaged between the projections 26 and the extensions 33 for applying resistance force to the foot posts 30 such that the feet of the users may step on the foot pedals 31 so as to conduct stepping exercises.

Accordingly, the horse-riding type exerciser in accordance with the present invention can be used for conducting both pull type horse riding exercises and stepping exercises.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base including a front portion having a pivot shaft provided therein, and including a rear portion having a track means provided therein, a seat post including a lower portion pivotally coupled to said base at said pivot shaft, and including an upper portion having a seat cushion provided thereon, and including a middle portion having a pair of projections extended therefrom, a pole means including a lower portion movably engaged in said track means and including an upper portion pivotally coupled to said middle portion of said seat post, a pair of foot posts each including a lower portion pivotally coupled to said lower portion of said seat post at a pivot axis and each including an upper portion having a foot pedal means provided thereon, said foot posts each including a middle portion having an extension extended therefrom, means pivotally coupling said foot posts to said pole means for moving said lower portion of said pole means along said track means so as to elevate said seat cushion when said foot posts are rotated about said pivot axis, and a pair of resilient elements pivotally coupled between said extensions and said projections respectively so as to resiliently coupling said foot posts to said seat post, said foot posts being allowed to be rotated about said pivot axis independently in order to conduct stepping exercises when said coupling means is disengaged from said foot posts.

2. An exerciser according to claim 1 further comprising a spindle provided in said middle portion of said seat post, a bar means including a first end pivotally coupled to said spindle and including a second end have a rod secured thereto, said coupling means including a link pivotally coupled between said rod and said pole means and including a lever having a first end pivotally coupled to said rod and having a second end pivotally coupled to said foot posts, said rod being rotated about said spindle by said lever when said foot posts are rotated about said pivot axis, and said lower portion of said pole means being moved along said track means by said link when said bar means is rotated about said spindle.

3. An exerciser according to claim 2 further comprising a pair of handle bars each including a lower portion secured to said bar means so as to rotate said bar means about said spindle.

* * * * *